United States Patent [19]

Schiel

[11] 4,308,097

[45] Dec. 29, 1981

[54] FORMER FOR PRODUCING A PAPER WEB

[75] Inventor: Christian Schiel, Heidenheim, Fed. Rep. of Germany

[73] Assignee: J. M. Voith GmbH, Fed. Rep. of Germany

[21] Appl. No.: 127,514

[22] Filed: Mar. 5, 1980

[30] Foreign Application Priority Data

Mar. 7, 1979 [DE] Fed. Rep. of Germany ..... 2908791

[51] Int. Cl.[3] ..... D21F 1/00; D21F 1/02

[52] U.S. Cl. ..... 162/293; 162/295; 162/317; 162/319

[58] Field of Search ..... 162/317, 318, 319, 320, 162/293, 295, 213, 214, 351, 203

[56] References Cited

U.S. PATENT DOCUMENTS 2,881,677 4/1959 Thomas ..... 162/213

3,352,748 11/1967 Krofta ..... 162/318

4,146,426 3/1979 Cartwright ..... 162/317

*Primary Examiner*—S. Leon Bashore

*Assistant Examiner*—Steve Alvo

*Attorney, Agent, or Firm*—Ostrolenk, Faber, Gerb & Soffen

[57] ABSTRACT

The disclosure concerns a former for use in a paper making machine, or the like, for producing a web of fibrous suspension on a wire. The former includes a sliding surface, past which a tensioned wire is moved. A duct for fibrous suspension opens on the sliding surface. The sliding surface on the two sides of the duct is shaped so that downstream of the duct in the direction of movement of the wire, a wedge shaped slot is defined between the wire and the sliding surface in which the suspension is received and from which it is dewatered.

6 Claims, 3 Drawing Figures

FORMER FOR PRODUCING A PAPER WEB

BACKGROUND OF THE INVENTION

The invention relates to a former for a web producing machine. The former of the invention is of the kind having a pressure shoe that presents a sliding surface which, viewed in a section taken in the running direction of the web, is curved convexly. An endless wire belt or screen, called a wire, is guided by the sliding surface of the pressure shoe.

Numerous formers of this kind are known. One example is described in German Laid-Open Patent Specification (DT-OS) No. 2,248,454 and corresponding U.S. Pat. No. 3,832,282. See, in particular, FIG. 1. This former has two wires which together form a wedgeshaped entry slot for the pulp suspension and the wires are then jointly conducted, with the paper web which is being formed, over the pressure shoe. The pressure shoe may be constructed as a suction box.

Although it has numerous advantages, this kind of double wire web producing machine also has disadvantages. There are added expenses involved in using a second wire as such. Extra problems arise in controlling the running of the wires.

SUMMARY OF THE INVENTION

An object of the invention is to provide a former for producing a paper web, which former is considerably cheaper and more compact, and which avoids the disadvantages of known twin wire web producing machines.

Another object is to provide a former which is suitable for producing multi-layer webs, such as cardboard, and which can be used at higher speeds than known cylinder mold formers.

According to the invention, the pressure shoe of the former defines a duct for the pulp suspension that opens out on its sliding surface.

Unlike known formers, in the former of the invention, the stream of pulp passes through the pressure shoe itself, across the full width of the web being formed, and emerges on the convex pressure or sliding surface of the shoe. There, the pulp meets with the wire that is guided by the pressure shoe, which is the only wire required. This wire is passed round the convex surface of the pressure shoe under tension so that it encases the emerging fibrous pulp suspension and extracts the water from it. During this process, the paper web from which the water has been extracted lies against the wire and is carried along by it, while the suspension with a low concentration of fibers can slide on the smooth sliding surface of the shoe. The arrangement, therefore, makes use of an advantage which normally appertains to twin-wire machines, namely, the fibrous pulp suspension is pressed out by the tensioning of the wire and thus by the de-watering pressure prevailing between the wires. In addition, however, there is also the advantage that now the centrifugal force does not act counter to the de-watering direction, but in the same direction. The centrifugal force forces the water through the wire. For this reason, there is virtually no upper speed limit for a former according to the invention. In addition, due to the elasticity of the wire, the gap between the wire and the shoe at the end of the web-forming zone is set automatically. Bothersome setting manipulations are thus eliminated, and the possibility of an incorrect setting is also eliminated. Only two quantities need be determined when setting up, namely, the amount of pulp to be supplied per unit of time, and the tension of the wire. Trouble-free operating behavior is thus assured.

Generally, the duct which opens out on the sliding surface of the pressure shoe is designed so that it has at least one component lying in the running direction of the adjoining wire, thus, lying at a certain inclination to the wire. Furthermore, it is expedient to design the outlet zone of the duct in a wedge shape so that it is formed, on one hand, by part of the pressure shoe and, on the other hand, by the wire itself.

The pressure shoe may be made up of two parts, a first, leading part which, viewed in the running direction of the wire, lies upstream of the discharge duct and on which the wire slides, and a second, downstream part, over which the de-watering of the web is carried out. This means that the wire rests against the outlet edge of the first shoe part and seals the discharge duct, force-locking against it. With a wedge-shaped design, as described above, the second shoe part is set back somewhat relative to the first part, so that the wire forms one "wall" of the discharge duct.

The curvature of the shoe as a whole may be constant in the running direction over its entire extent. However, it may also be varied in the running direction, according to the special de-watering conditions involved. There is an optimum path for the curvature for each pulp suspension product, each wire tension and each running speed, and this may be determined by the known formulae of de-watering theory. In this case, the friction of the pulp on the upper lip must also be taken into consideration. From these values an optimum compromise must be found. This compromise is closely approached if the curvature radius over the length of the shoe is initially rapidly increased in the running direction for example and is then increased more slowly, by a factor of 2.

In order to ensure that no pulp can escape between the wire and a first region of the shoe, counter to the running direction, provision is made for the radius of the first region of the shoe to be made smaller at least in its discharge zone than the mean radius of curvature of a second region of the shoe. As a whole, the radius of the second shoe region must be smaller at its discharge zone than the curvature of the wire at the beginning of the de-watering process, so that the wire is not lifted up from the first shoe region.

Provision may also be made for a plurality of web-forming stations to be provided on the same revolving elongated wire, to produce multi-layer webs, and for each web produced to be couched before the next station, for example, on a felt, another wire or on the surface of a roller.

So that it is not necessary to press out an excessive amount of water when couching, it may be advantageous, particularly when producing thick webs, to sweep away the film of water under the strainer with a wiper blade between the web-forming unit and the couching press. This de-watering effect can be further enhanced by using a suction box instead of a wiper blade in this position.

It is particularly advantageous and inexpensive if the two curved shoe parts are attached directly to the pulp distributer. This means that the conventional head box can be dispensed with and only a supply pipe with a distribution grid remains.

Finally, it is advantageous always to arrange the second shoe part above the associated section of the wire in the de-watering zone, since in this case, in addition to centrifugal force, gravity enhances the removal of the water pressed through the wire.

Other objects and features of the invention may be understood from the following description and accompanying drawings.

DESCRIPTION OF THE PREFERRED EMBODIMENT

Figure 1:
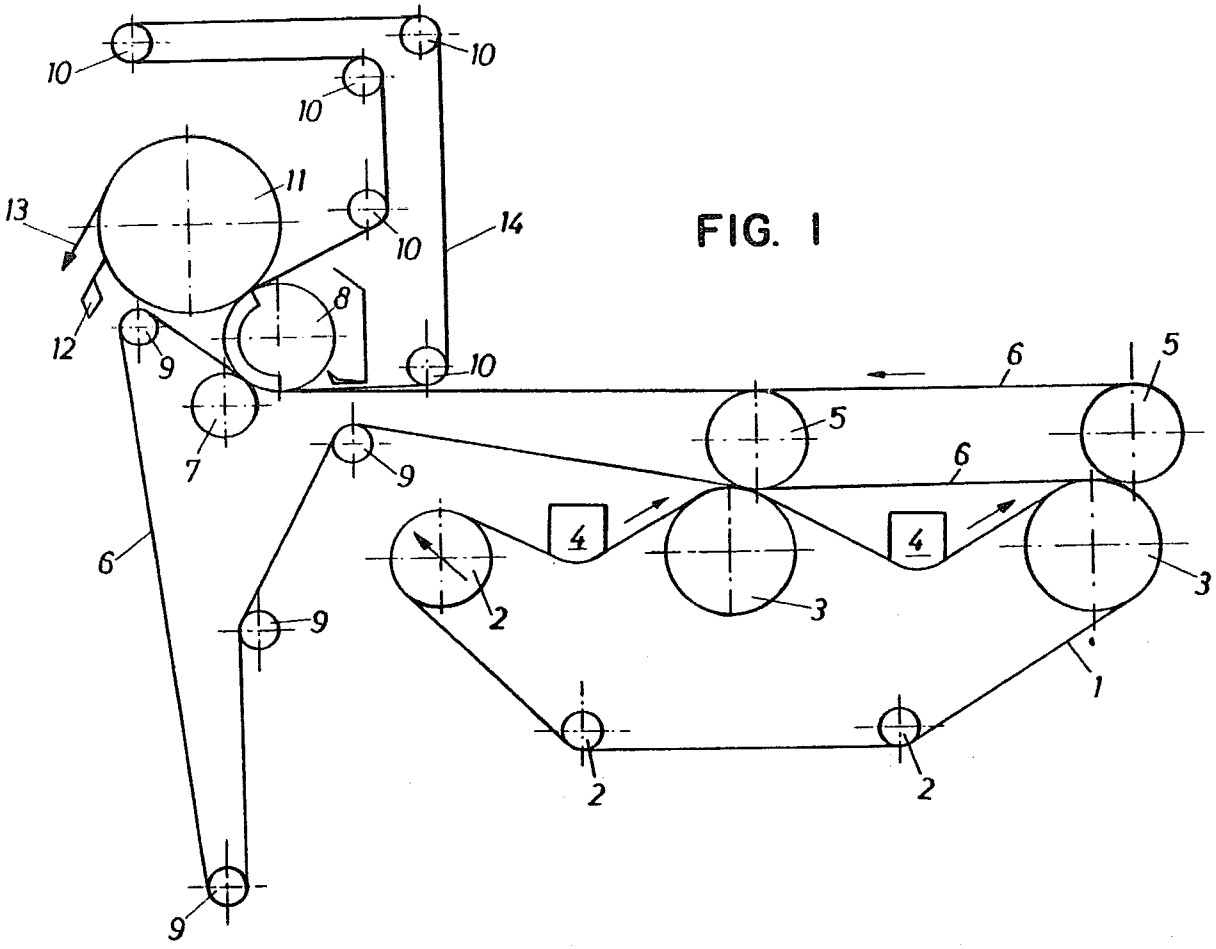
FIG. 1 shows a simplified circuit diagram of the wet section of a web producing machine for the production of multi-layer webs.

Referring to FIG. 1, an endless elongated wire 1 is driven along a revolving path by guide, regulating and tensioning rollers 2, together with dandy rolls 3. In front of each dandy roll 3, a web-forming unit 4 is arranged in the wire 1 in such a way that it presses on the wire 1 from above and the wire is deflected around it through an angle of approximately 45 to 90 degrees. In the zone where the wire is deflected around, the paper pulp is delivered from above onto the wire 1 and is de-watered through the wire. Above the dandy rolls 3, couching rollers 5 are arranged which, together with the former, form a pressing gap and press out the webs formed on the web-forming units 4 and couch them onto the other side of an endless conveying felt 6 (a long screen comprised of a felt fabric). The multi-layer web 13 thus formed is carried by the conveying felt 6 into a pressing gap between a pressing roller 7 and a suction-pressing roller 8. The conveying felt 6 runs over guide, tensioning and regulating rollers 9 back to the first of the couching rollers 5.

An over-felt 14 runs together with the web 13 into a pressing gap between the roller 8 and a roller 11 and there the web is transferred from the felt 14 onto the roller 11, which latter is equipped with a wiper blade 12. The pressed paper web 13 is drawn off the roller 11 in front of this wiper blade 12. The felt 14 runs over guide, tensioning and regulating rollers 10 back to the suction-pressing roller 8.

Figure 2:
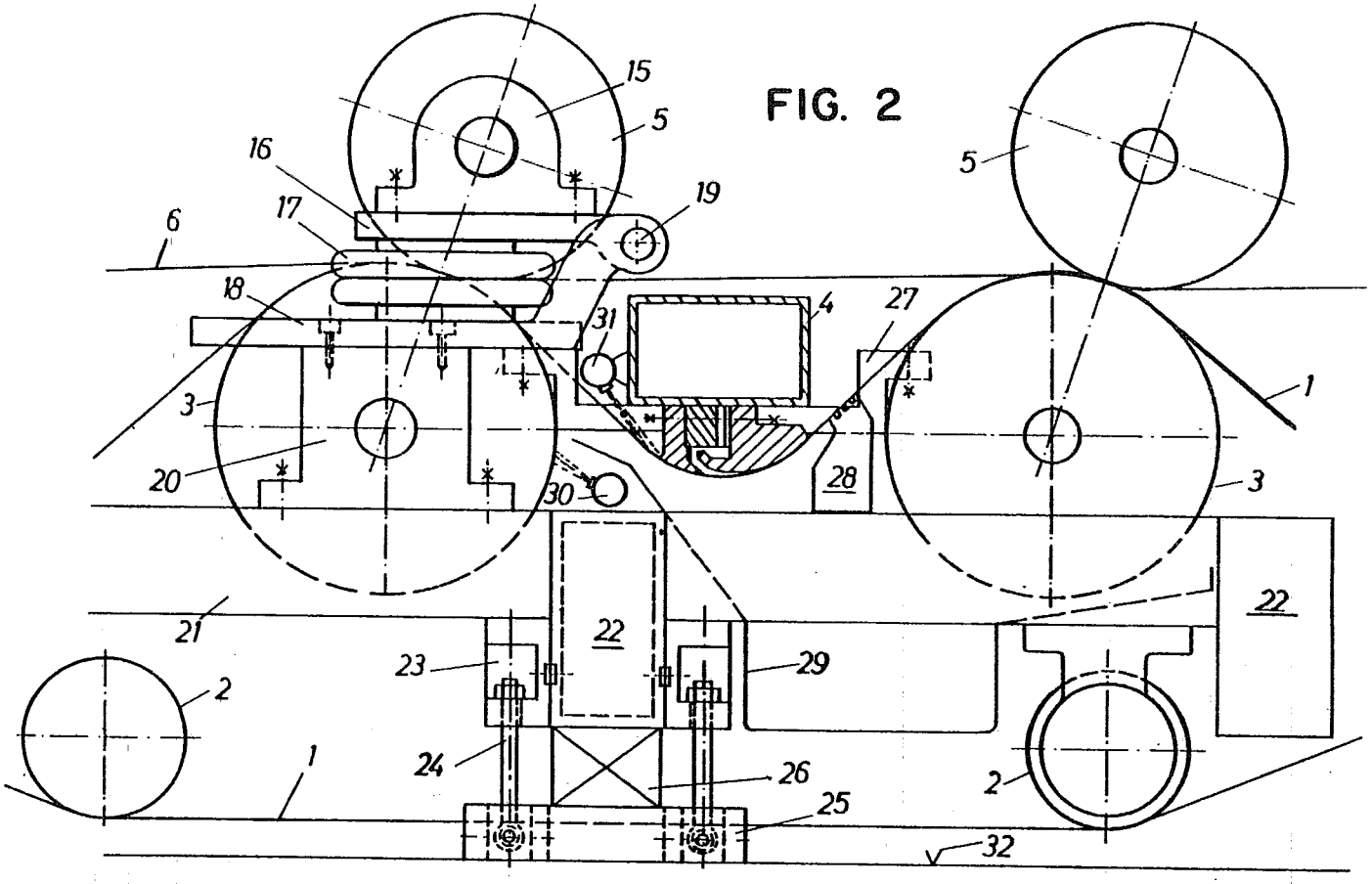
FIG. 2 shows a detail of this machine, partly viewed from the side and partly in section.

In FIG. 2 the corresponding parts are designated with the same numerals as in FIG. 1. Referring to FIG. 2, the couching rollers 5 are rotatably located in bearings 15 which are attached to levers 16. The pressure of the roller 5 against its respective dandy roll 3 preferably arises due to the inherent weight of the roller 5 and can be reduced by air pressure in air spring bellows 17. The spring bellows 17 are installed between the levers 16 and frames 18, which are connected via linkages 19. These frames 18 are attached to the bearing housings 20 of respective dandy rolls 3, and the bearing housings 20 are seated on longitudinal cross beams 21 which are attached, for example, via brackets 23 to transverse bearing members 22. The transverse bearing members 22 are supported on at least one side of the machine on removable spacer pieces 26 and are drawn down onto these by means of swing bolts 24. The swing bolts 24 are pivotably mounted in base plates 25. The base plates 25 are attached to rails or beams 32 in the bedplate.

The web-forming unit 4 is suspended on brackets 27, and a suction box 28 takes care of additional de-watering of the formed web. The water pressed through the wire during the de-watering of the web is conducted away in a wire water gutter 29. Spraying pipes 30 clean the dandy roll 3, and spraying pipes 31 clean the wire 1 in front of each web-forming unit 4. The wire is additionally cleaned by supplementary cleaning spray pipes along the return path of the wire (not shown).

Figure 3:
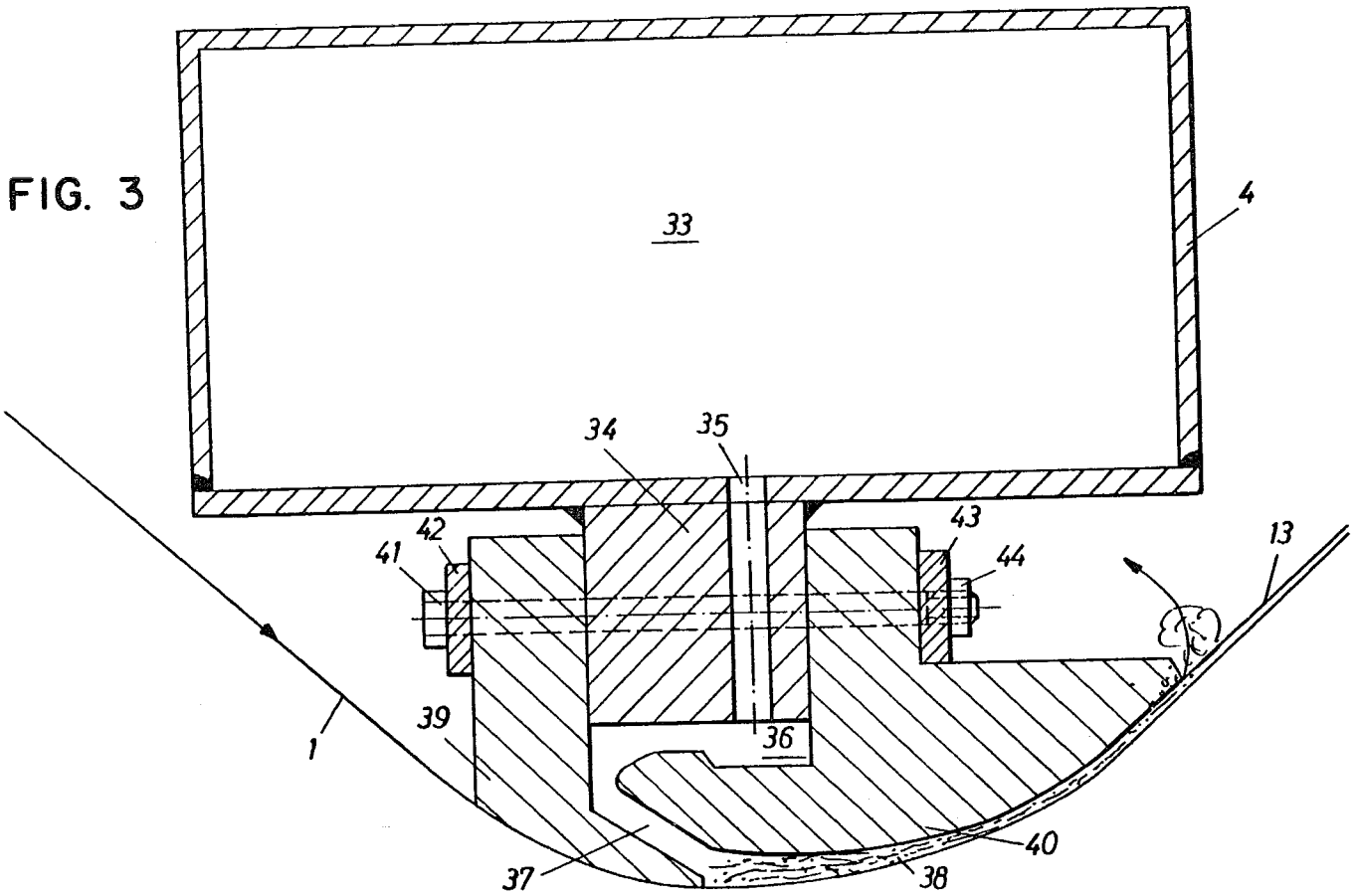
FIG. 3 is a section through a single web-forming unit.

Referring to FIG. 3, the web-forming unit 4 comprises a supply duct 33 extending over the width of the machine, out of which the pulp flows via distribution channels 35 in a distribution block 34 into a mixing chamber 36. The distribution duct 33 may be formed in a normal way, with a reducing cross-section from the run-in side to the opposite side.

The wire 1 is conducted to the web-forming unit 4 over a curved first leading or upstream shoe part 39. In the chamber 36, a stream of pulp the width of the machine is formed and this arrives via a discharge duct 37 into a wedge-shaped web-forming space 38. The height of the pulp is reduced by de-watering due to the pressure which is exerted by the wire 1 on the pulp suspension, and at the end of a second, downstream web-forming shoe part 40, the web, with its fiber structure fixed, leaves the web-forming space 38.

The shoe parts 39 and 40 are attached to the distribution block by means of bolts 41. The heads 41 of the bolts press the shoe part 39 via a bar 42 against the distribution block 34, while the nuts 44 press the shoe part 40 via a bar 43 against the distribution block 34. The chamber 36, duct 37 and web-forming space 38 are closed off at the sides by cover plates (not shown) which approximately follow the contour of the wire in the vicinity of the space 38.

As shown in FIG. 3, the shoe part 39 projects further toward the wire 1 in the vicinity of the duct 37 than the shoe part 40. This lifts the wire 1 off the shoe part 40 and enable the wedge shaped space 38 to be formed.

Also, the shoe part 40 has a curvature with a radius that gradually increases in the direction downstream of the wire movement. Specifics of the curvature of the surface are explained in the general description above.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A former for producing a web of paper, or the like, from a fibrous pulp suspension, comprising:

a pressure shoe having a sliding surface thereon; a duct in the pressure shoe and opening out on the sliding surface for exit of pulp suspension to the sliding surface;

wire and means for sliding the wire past the sliding surface and past the duct, whereby pulp suspension may be picked up on and carried along on the wire;

the pressure shoe sliding surface comprising two parts, a first part upstream in the path of the wire for engaging and guiding the wire past the duct and a second part downstream in the path of the wire past the duct; the sliding surface being so shaped that the downstream part thereof is normally spaced away from the wire moving past the downstream part; the upstream part of the sliding surface, at the duct, projecting out more toward the wire than the downstream part of the sliding surface, at the duct, so that the wire is spaced farthest away from the downstream part of the sliding surface at the duct; said wire and said sliding surface defining a tapered dewatering discharge zone between the downstream part and the wire.

2. The former of claim 1, wherein the downstream part of the sliding surface is shaped so that the discharge zone downstream on the duct along the sliding surface is generally wedge shaped, being of wider cross-section nearer the duct.

3. The former of claim 1, wherein the sliding surface has a gradually increasing radius of curvature, at least downstream of the duct, in the direction of movement of the wire.

4. The former of claim 1, including means for tensioning the wire against the sliding surface.

5. The former of either of claims 1 or 8, wherein the sliding surface is convexly curved.

6. The former of claim 1, further comprising a wiper blade downstream in the path of the wire from the sliding surface, and the wiper blade contacting the surface of the wire to which pulp suspension had been applied at the duct.

* * * * *